United States Patent [19]

Siptrott

[11] 4,357,797

[45] Nov. 9, 1982

[54] UNIFIED ACTION HYDROCENTRIFUGAL MACHINES

[76] Inventor: Fred M. Siptrott, 3011 Hardies La., Santa Rosa, Calif. 95401

[21] Appl. No.: 130,415

[22] Filed: Mar. 14, 1980

[51] Int. Cl.[3] ..... F01D 13/00

[52] U.S. Cl. ..... 60/330; 415/72

[58] Field of Search ..... 60/325, 330; 415/71, 415/72, 73

[56] References Cited

U.S. PATENT DOCUMENTS

| | | | |
|---|---|---|---|
| 638,073 | 11/1899 | Smith | 415/71 |
| 1,065,732 | 6/1913 | Schneible | 415/71 |
| 2,764,101 | 9/1956 | Rand | 415/72 |
| 3,264,827 | 8/1966 | Siptrott | 60/325 |
| 3,434,284 | 3/1969 | Siptrott | 60/486 |
| 3,487,784 | 1/1970 | Rafferty et al. | 415/71 |
| 3,877,835 | 4/1975 | Siptrott | 415/143 |

*Primary Examiner*—H. Jay Spiegel

*Attorney, Agent, or Firm*—Schapp and Hatch

[57] ABSTRACT

A hydrocentrifugal machine is disclosed in which the rotor is a vortex-expeller rotor defining two generally spiral-shaped vortex-expeller passages and a hydraulic induction coil comprising a helical, inwardly-opening channel is affixed to the inner face of the outer, cylindrical wall of the centrifugation chamber.

4 Claims, 5 Drawing Figures

UNIFIED ACTION HYDROCENTRIFUGAL MACHINES

FIELD OF THE INVENTION

My invention relates to hydrocentrifugal machines of the kind shown and described in my U.S. Pat. Nos. 3,264,827 and 3,434,284, issued on Aug. 9, 1966, and Mar. 25, 1969, respectively, and more particularly to improved hydrocentrifugal machines characterized by a unified mode of action in each of which there is incorporated a hydroturbine of the kind shown and described in my U.S. Pat. No. 3,877,835, issued Apr. 15, 1975.

DESCRIPTION OF THE PRIOR ART

Hydrocentrifugal machines are shown and described in my prior art U.S. Pat. Nos. 3,264,827 and 3,434,284.

Characteristically, the hydrocentrifugal machines of these patents each comprise a sealed centrifugation chamber, a rotor mounted within the centrifugation chamber for rotation therewithin about a vertical axis, motive means for rotating said rotor about said axis, a hydroturbine mounted upon said centrifugation chamber and provided with an output shaft adapted to be coupled to a mechanical load, conduits extending from opposed points of the periphery of the centrifugation chamber to the intake ports of the turbine, and turbine efflux conduit means including a perforated or foraminous cylindrical conduit which is integral with said rotor and coaxial therewith.

The term "hydrocentrifugal machine" as used herein denotes machines of the kind broadly described in the previous paragraph.

However, unlike the hydrocentrifugal machines of my present invention, the machines of my abovesaid hydrocentrifugal machine patents are not provided with novel vortex-expeller rotors of the kind shown and described in FIG. 3 hereof, which rotors constitute a principal feature of my invention, nor provided with novel hydraulic induction coils of the kind shown in FIG. 2 hereof, which coils constitute a second principal feature of my invention.

Lacking these principal features of my present invention, the hydrocentrifugal machines of my said hydrocentrifugal machine patents do not attain the advantages which characterize the hydrocentrifugal machine of my present invention.

SUMMARY OF THE INVENTION

Accordingly, it is an object of my present invention to provide hydrocentrifugal machines which provide advantages not attainable in the hydrocentrifugal machines of the prior art.

Another object of my present invention is to provide hydrocentrifugal machines which incorporate the advantages of turbines which utilize two fields of energy in one operation, namely, high and low pressure, such as the high and low pressure turbines of my said U.S. Pat. No. 3,877,835.

A further object of my invention is to provide hydrocentrifugal machines which utilize the advantages of rolling friction to minimize the energy required to rotate their rotors in their centrifugation chambers;

A yet further object of my invention is to provide hydrocentrifugal machines adapted to optionally utilize the advantages of my vortex-expeller rotor invention;

An additional object of my present invention is to provide hydrocentrifugal machines which optionally utilize the advantages of my hydraulic induction coil invention.

Other objects of my present invention will in part be obvious and will in part appear hereinafter.

My present invention, accordingly, comprises the apparatus embodying features of construction, combinations of elements, and arrangements of parts, all as exemplified in the following disclosure, and the scope of my present invention will be indicated in the appended claims.

In accordance with a principal feature of my present invention hydrocentrifugal machines are provided the rotors of which are mounted on ball bearings within their respective centrifugation chambers.

In accordance with another principal feature of my present invention hydrocentrifugal machines are provided the turbines of which utilize two fields of energy in one operation, namely high and low pressure, such as the high and low pressure turbines of my abovesaid U.S. Pat. No. 3,877,835.

In accordance with a further principal feature of my present invention hydrocentrifugal machines are provided the stator chambers of which contain hydraulic induction coils embodying my hydraulic induction coil invention;

In accordance with an additional principal feature of my invention hydrocentrifugal machines are provided in which the respective rotors embody my vortex-expeller-converter invention, which rotors operate on the basis of a universal law which I call the "inclined circle law," the operation of which law results in a kinetic differential of mass;

In accordance with a yet further principal feature of my invention hydrocentrifugal machines are provided which utilize the phenomenon of liquid mass induction, which phenomenon is a characteristic of my said hydraulic induction coil invention;

Another principal feature of my present invention is my hydraulic induction coil invention itself, which is a separate invention in and of itself, and which, in conjunction with the kinetic mass differential created by rotors embodying my vortex-expeller-converter invention will produce unprecedented liquid mass velocities and corresponding values of other hydraulic parameters;

Yet another principal feature of my present invention is my vortex-expeller-converter invention itself, which is a separate invention in and of itself.

For a fuller understanding of the nature and objects of my present invention reference should be made to the following detailed description, taken in connection with the accompanying drawings.

DESCRIPTION OF THE PREFERRED EMBODIMENTS

Figure 1:
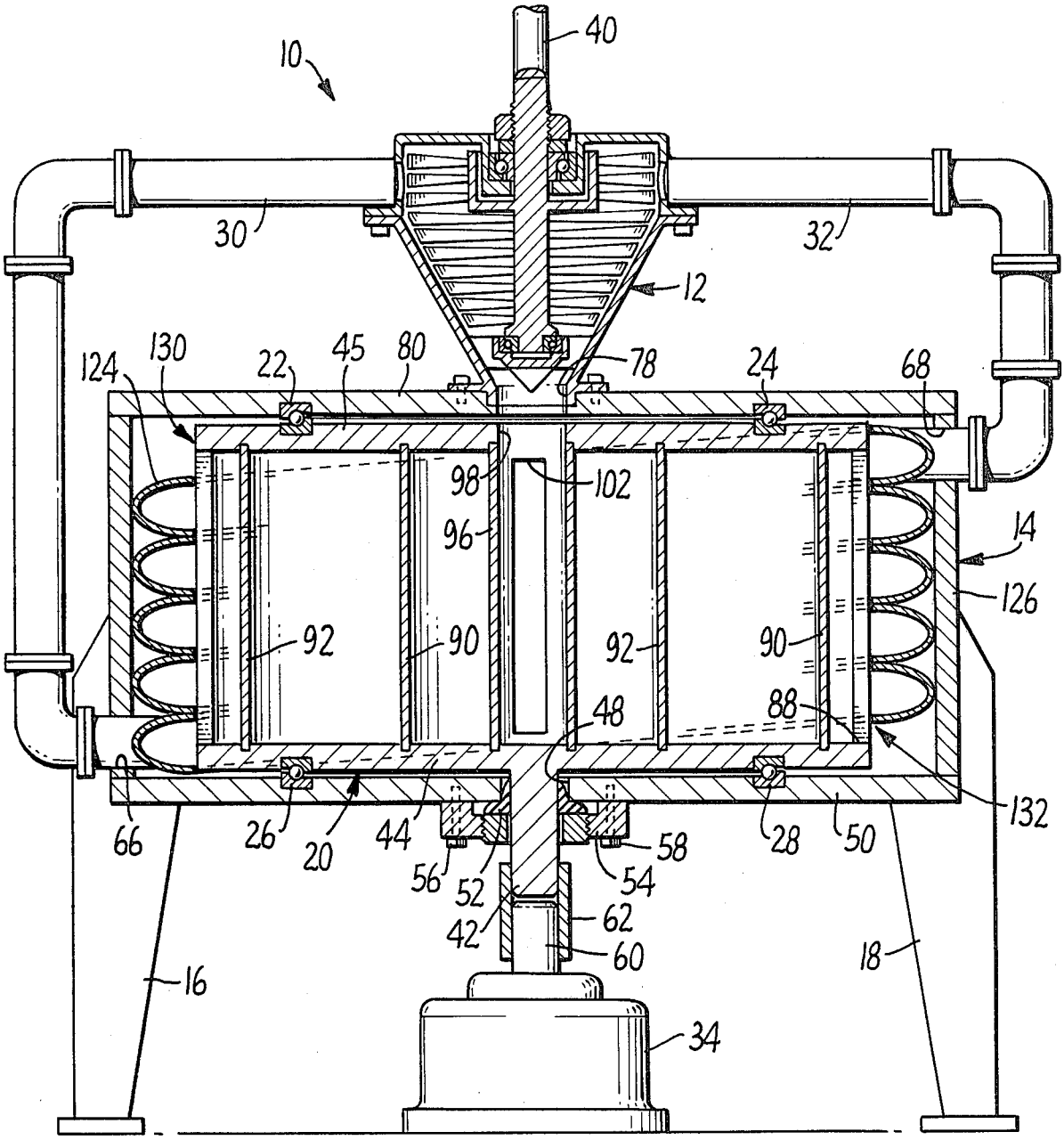
FIG. 1 is an elevational view, partly in section, of a hydrocentrifugal machine embodying several of the principal features of my present invention.

Referring now to FIG. 1, there is shown a hydrocentrifugal machine 10 embodying my present invention.

In the manner now well known from my abovesaid hydrocentrifugal machine patents, hydrocentrifugal machine 10 comprises a hydroturbine 12, a stator chamber 14, conveniently mounted on legs 16, 18, etc., a rotor 20 rotatably mounted in stator chamber 14 by means of ball bearings 22, 24, 26, 28, etc., penstocks 30 and 32 providing fluid communication between the outer periphery of stator chamber 14 and the respective intake ports of hydroturbine 12, and a driving power supplying electric motor 34.

In the well known manner, hydroturbine 12 is provided with a power output shaft 40, to which mechanical loads will be coupled during the operation of hydrocentrifugal machine 10.

As seen in FIG. 1, rotor 20 is provided with a downwardly depending shaft 42, which is integral with the lower wall 44 of rotor 20. The upper wall of rotor 20 is denoted by the reference numeral 45. Rotor 20 also comprises an upper wall 45. Shaft 42 passes through an opening 48 in the lower wall 50 of stator chamber 14. Shaft 42 is rotatably, fluid-tightly sealed in opening 48 by means of packing 52. Packing 52 is maintained in opening 48, to rotatably seal shaft 42 to the wall of opening 48, by means of a gland cover 54, which is itself held in position by bolts 56, 58, etc., all in the well known manner.

As further seen in FIG. 1, electric motor 34 is provided with an output shaft 60. Rotor shaft 42 and electric motor shaft 60 are intercoupled for conjoint rotation by means of a sleeve 62, which is affixed both to rotor shaft 42 and to electric motor shaft 60. Other well known shaft coupling means may be substituted for sleeve coupling 62 without departing from the scope of my invention.

As also seen in FIG. 1, stator chamber 14 is completely closed and sealed against the leakage therefrom of the water or other working fluid contained therein. The only openings in stator chamber 14 are (1) the aforesaid opening 48 through which rotor shaft 42 passes, (2) the openings 66 and 68 through which penstocks 30 and 32 pass, respectively weld sealed, and (3) the opening 78 in the upper wall 80 of stator chamber 14.

As seen in FIG. 1, opening 66 close-fittingly embraces penstock 30. Penstock 30 is fluid-tightly weld seal affixed, throughout its associated periphery, to the wall of opening 66, whereby none of the working fluid in stator chamber 14 can leak therefrom through the joint between the cylindrical wall of chamber 14 and penstock 30. Similarly, penstock 32 is affixed to the wall of opening 68 in chamber 14 in such manner that no working fluid can leak from chamber 14 through the joint between penstock 32 and chamber 14.

As also seen in FIG. 1, the lower extremity of hydroturbine 12 is fluid-tightly affixed to the upper wall 80 of centrifugation chamber 14 over the area surrounding opening 78, in such manner that the working fluid can pass readily from the interior of hydroturbine 12 to the interior of stator chamber 14, via opening 78, but cannot escape at the joint between hydroturbine 12 and the upper wall 80 of stator chamber 14.

Further, leakage of working fluid through opening 48 is substantially completely prevented by packing 52, etc.

Thus, it will be seen that the hydrocentrifugal machine of FIG. 1 is so constructed that the working fluid therewithin remains complaced, even under full operating pressure.

Thus, the working fluid in the hydrocentrifugal machine 10 of FIG. 1 will be seen to be confined to a working space consisting of (a) the space within hydroturbine 12, (b) the space within rotor 20, (c) the space within stator 14, and (d) the space within penstocks 30 and 32.

It is to be understood that in the preferred embodiment of my invention shown in FIGS. 1 through 4 hereof the entire working space is filled with the working fluid, i.e., water, and the water, while it completely fills the working space, is not maintained under static pressure when hydrocentrifugal machine 10 is at standstill.

As may also be seen from FIG. 1, the working fluid in hydrocentrifugal machine 10 of the preferred embodiment circulates around two paths or loops during the operation thereof.

The first working fluid circulation path or loop of hydrocentrifugal machine 10 extends from opening 78 through the interior of rotor 20 by way of outlet windows 100 and 102 thence through vortex expeller passages 120 and 122 through expulsion ports 108 and 110 into induction coil 124 of stator 14, thence through penstock 30 into hydroturbine 12 and downwardly to opening 78. Thus, this first working fluid circulation path is a continuous closed path.

The second working fluid circulation path is functionally synonymous to the first and follows the same path down and into induction coil 124 and exits into penstock 32 through turbine 12 and downwardly through 78. Thus, the second working fluid circulation path is also a continuous closed path.

For a complete description of hydroturbine 12, reference is hereby made to my said U.S. Pat. No. 3,877,835.

It will be understood by those having ordinary skill in the art, informed by the present disclosure, that during the operation of the hydrocentrifugal machine 10 of FIG. 1 electric motor 34 is continuously energized (via a suitable cable, not shown), and thus continuously rotates rotor 20 about its axis, i.e., about the axis of its shaft 42.

Figure 3:
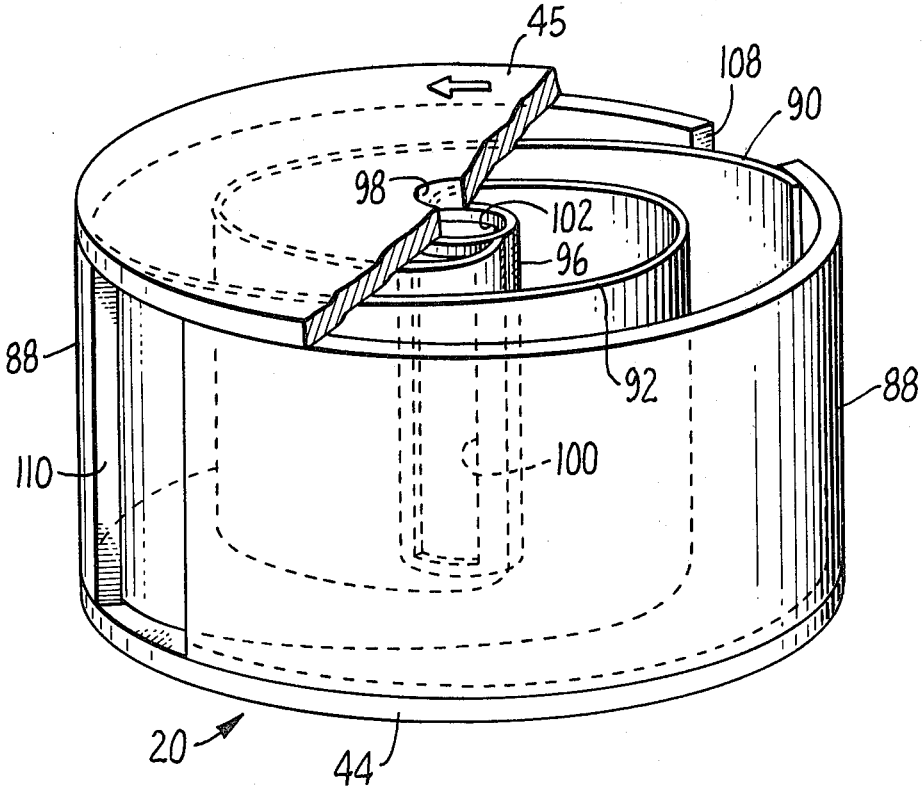
FIG. 3 is a perspective view, partly in section, of the rotor of the hydrocentrifugal machine of FIG. 1, which rotor is a vortex-expeller rotor embodying my vortex-expeller converter invention.
Figure 4:
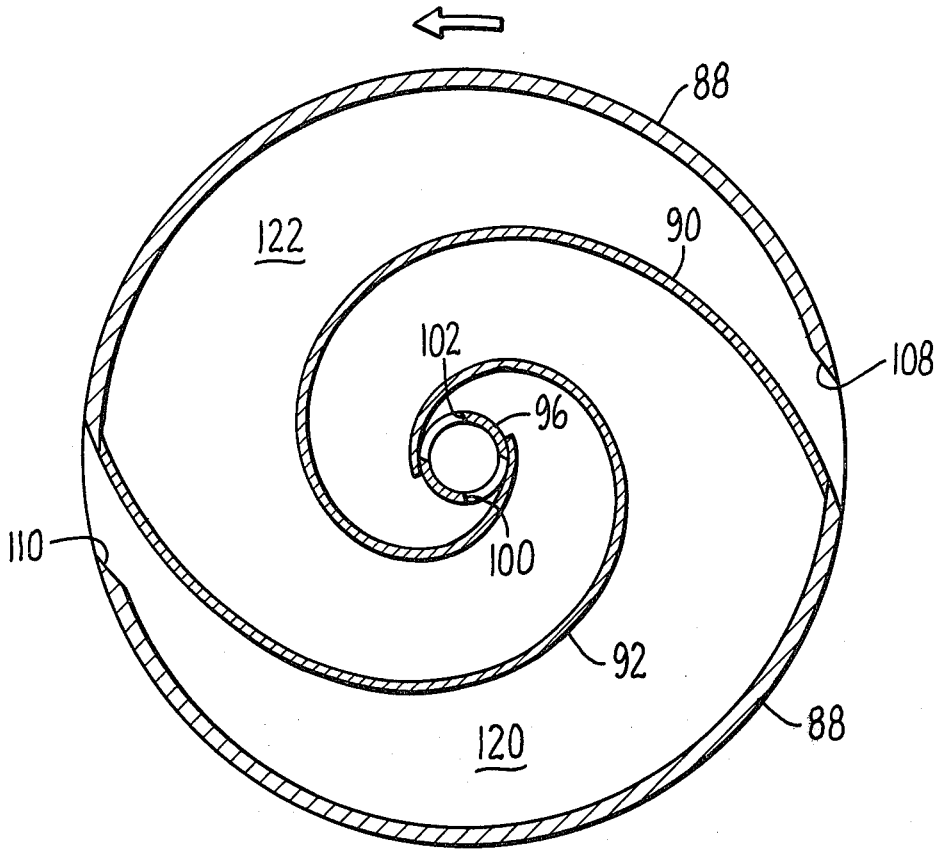
FIG. 4 represents a cross-section of the vortex-expeller rotor of FIG. 3, taken along line 4—4 of FIG. 3.

The vortex-expeller rotor 20, which is a principal feature of my present invention, may best be understood by comparing FIGS. 1, 3, and 4.

As seen in FIG. 3, rotor 20 comprises lower wall 44, upper wall 45, and cylindrical outer wall 88, which three walls are fluid-tightly affixed to each other. (For clarity of illustration the shaft 42 of rotor 20 is not shown in FIG. 3.)

As may best be seen by comparison of FIGS. 3 and 4, rotor 20 contains two rigid partitions 90 and 92, both of which extend from wall 44 to wall 45 and are received in suitable channels in walls 44 and 45. By means of these channels partitions 90 and 92 are rigidly maintained in respective predetermined positions in rotor 20. Partitions 90 and 92 constitute a principal feature of my invention, and may be referred to as "vortex-expeller walls" herein.

As best seen by comparison of FIGS. 1 and 4, rotor 20 also comprises a central perforated or foraminous pipe or tube 96, which extends from upper wall 45 to lower wall 44 of rotor 20. It can be seen in FIG. 1 that pipe or tube 96 is received in suitable channels in upper wall 45 and lower wall 44 of rotor 20.

Referring now to FIG. 4, it will be seen that vortex-expeller walls 90 and 92 both extend from rotor inlet pipe 96 to outer cylindrical rotor wall 88.

As will now be obvious to those having ordinary skill in the art, informed by the present disclosure, the space within rotor 20 between inlet pipe 96 and outer wall 88 is divided into two generally spiral shaped channels or passages 120 and 122 by means of vortex-expeller walls 90 and 92. Preferably, vortex-expeller walls 90 and 92 are fluid-tightly affixed to inlet pipe 96, and to walls 44, 45, and 88.

The respective ends of inlet pipe 96 are fluid-tightly sealed to the planar walls 44 and 45 of the rotor 20. The upper end of inlet pipe 96 is aligned with an opening 98 in upper wall 45 of rotor 20. The lower end of inlet pipe 96 is closed by the registered portion of lower rotor wall 44.

Referring again to FIG. 4, it will be seen that inlet pipe 96 is provided with two perforations or windows 100 and 102 which pass completely therethrough and thus provide fluid passage from the interior of inlet pipe 96 to the exterior thereof.

As seen in FIG. 1 and 3, the windows 100 and 102 in inlet pipe 96 extend longitudinally for substantially the entire distance between upper rotor wall 45 and lower rotor wall 44.

As best seen by comparison of FIGS. 3 and 4, two ports 108, 110 pass through outer wall 88 of rotor 20. Port 108, like port 110, is of uniform width, and extends from upper wall 45 to lower wall 44 of rotor 20. Ports 108 and 110 are called "expulsion ports" herein. Expulsion ports 108 and 110 are disposed in diametric opposition, as may be seen in FIG. 4.

Referring again to FIG. 4, it will be seen that vortex-expeller walls 90 and 92, and outer rotor wall section 88', together define a generally spiral-shaped passage extending from inlet port 100 to expulsion port 110. This passage will sometimes be called herein vortex-expeller passage 120.

Referring again to FIG. 4, it will be seen that vortex-expeller walls 90 and 92, and outer rotor wall section 88'', together define a generally spiral-shaped passage extending from intake port 102 to expulsion port 108. This passage will sometimes herein be called vortex-expeller passage 122.

Referring again to FIG. 1, it will be seen that upper wall 45 of rotor 20 is disposed closely adjacent to upper wall 80 of stator chamber 14. Thus, the lower end of opening 78 is disposed closely adjacent to the upper end of opening 98, and thus any leakage seeping through the bearings 22 and 24 will be retained by a sliding disk gasket made of packing material, as seen in U.S. Pat. No. 3,264,827.

Thus, the water or other working fluid leaving hydroturbine 12 via opening 78, in the manner described hereinabove, will substantially all pass into inlet pipe 96, and thence through the respective inlet windows 100, 102 and into the respective vortex-expeller passages 120, 122. The water leaving vortex-expeller passages 120 and 122 must pass through expulsion ports 108, 110, respectively, and thence into the hydraulic induction coil of my invention which is shown in FIGS. 1 and 2 and designated by the reference numeral 124.

It is to be understood that the configuration of vortex-expeller walls 90 and 92, and the geometry of their coaction with outer wall 88 and ports 100, 102, 108, 110, all as shown in FIG. 4, constitute a principal feature of my invention.

Vortex-expeller walls 90 and 92 are both contoured in the form of an inclined circle, which contour constitutes a principal feature of my invention in itself. In the preferred embodiment in cross-section as seen in FIG. 4, the vortex-expeller walls 90 and 92 have in fact the shape of a spiral.

Figure 2:
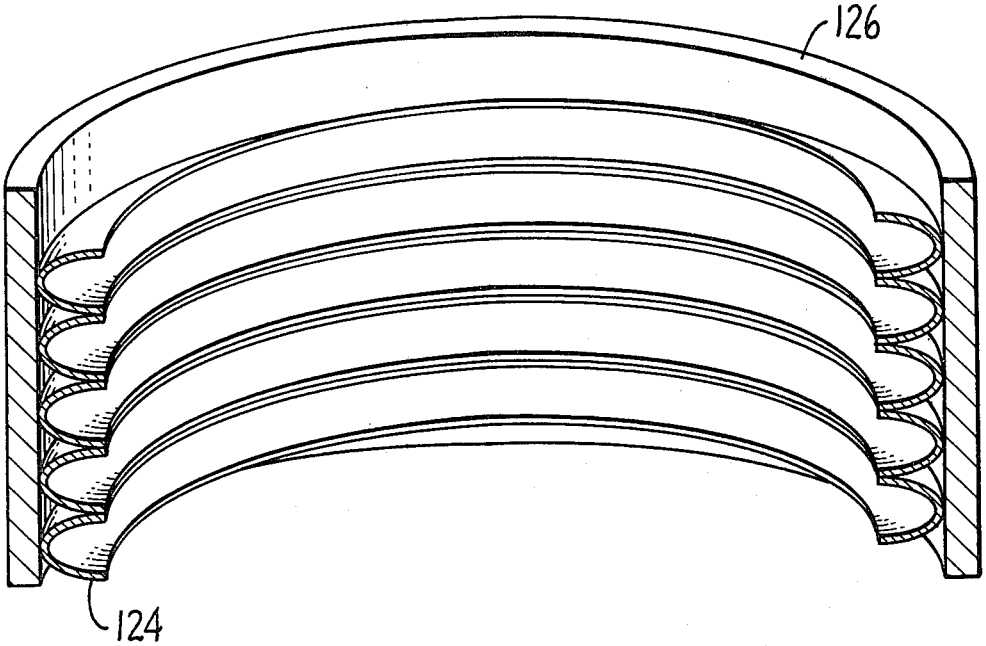
FIG. 2 is a partial perspective view of the outer wall of the stator chamber of the hydrocentrifugal machine of FIG. 1, showing the hydraulic induction coil embodying my hydraulic induction coil invention which constitutes a part thereof.

Referring now to FIG. 2, and comparing the same with FIG. 1, it will be seen that hydraulic induction coil 124 is a continuous, helical channel, the adjacent turns of which are in contact, and are preferably joined together in fluid-tight manner.

As can also be seen, hydraulic induction coil 124 is affixed to the inner surface of the outer cylindrical wall 126 of stator chamber 14.

While the turns of hydraulic induction coil 124 may be seen in FIGS. 1 and 2 to be of semi-eliptical cross-section, it is to be understood that in other embodiments of my present invention the cross-section of the turns of the hydraulic induction coil may be semicircular or rectangular. It is to be understood, however, that in every embodiment of the unified action machine of my present invention the hydraulic induction coil constitutes a helically-disposed channel, the adjacent lip edges of which are joined, and lie in a common cylindrical surface of stator 14 which is larger in diameter than rotor wall 88 to the extent of the size of coil employed.

As seen in FIG. 1, the ends of hydraulic induction coil 124 are fluid-tightly joined to the lower ends of penstocks 30 and 32, respectively.

Put differently, the hydraulic induction coil of FIG. 1, which constitutes a principal feature of my invention, is so constructed and arranged as to present a continuous open face directly to the outer face of rotor 20, in very close juxtaposition thereto throughout its length.

Thus, it will be seen that by far the greatest part of the water exiting from rotor 20 through expulsion ports 108 and 110 will pass directly into the several turns of hydraulic induction coil 124 through said continuous open face thereof.

As will further be obvious to those having ordinary skill in the art, informed by the present disclosure, the water thus injected into the continuous channel of hydraulic induction coil 124 through the expulsion ports 108 and 110 of rotor 20 can only leave hydraulic induction coil 124 through the ends thereof, which are directly, fluid-passingly, joined to penstocks 30 and 32, respectively, discounting the small leakage between the outer lips of hydraulic induction coil 124 and the outer surface of rotor 20, e.g., at the points indicated by the reference numerals 130 and 132 in FIG. 1.

Having described in detail the structure of the preferred embodiment of my invention shown in FIGS. 1 through 4, the operation of that preferred embodiment in accordance with the principles of my invention will now be described.

OPERATION

During the operation of the hydrocentrifugal machine 10 of the preferred embodiment, electric motor 10

(FIG. 1) is continuously energized, and thus rotor 20 is continuously rotated in stator chamber 14.

Due to the conjoint operation of the vortex-expeller rotor 20, which constitutes a principal feature of my invention, and hydraulic induction coil 124, which also constitutes a principal feature of my invention, the rotation of vortex-expeller rotor 20 results in high hydrodynamic pressure in hydraulic induction coil 124, and thus in penstocks 30 and 32.

The high fluid pressure in penstocks 30 and 32 forces high pressure streams of water into the intake ports of hydroturbine 12.

The mass of water (hydromass) thus forced through hydroturbine 12 results in the rotation of the output shaft 40 of hydroturbine 12 about its axis in accordance with the principles taught in my abovesaid U.S. Pat. No. 3,877,835.

Due to the unified action mode of operation characteristic of my present invention, the output torque produced at hydroturbine output shaft 40 is very high, and can be used to operate considerable mechanical loads coupled thereto.

The effluent from hydroturbine 12 flows downwardly through openings 78 and 98, and into hollow inlet shaft 96 of rotor 20, whence if flows through windows 100 and 102 (FIG. 4) and thus enters vortex-expeller passages 120 and 122.

In vortex-expeller passages 120 and 122 the hydromass injected through windows 100 and 102 is subjected to the increasing force of centrifugation imparted by means of rotor 20 in accordance with the principles of my invention.

The increasing force of centrifugation is thus imparted, inter alia, because the vortex-expeller walls 90 and 92 are contoured in the form of an inclined circle, as shown in FIG. 4 as opposed to inclined plan, and each vortex-expeller passage 120, 122 terminates in its own expulsion port 108, 110 (FIG. 4). That is to say, the individual water particles or watermasses, after passing through inlet windows 100, 102, are impinged against vortex-expeller 90, 92 with ever increasing force due to the gradually enlarging available radius of expansion.

Figure 5:
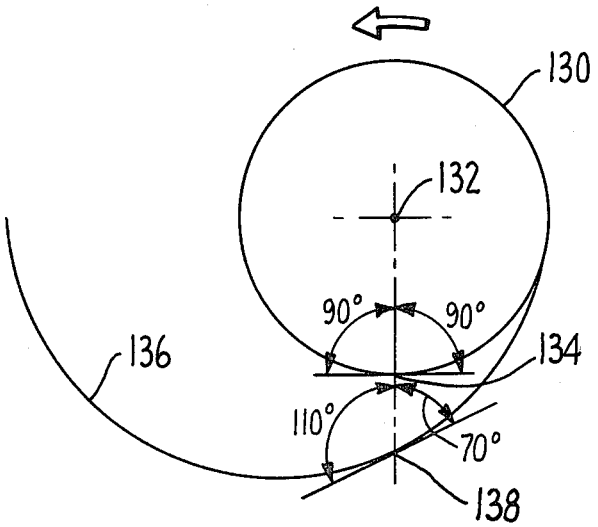
FIG. 5 is a diagram illustrating the kinetic differential of hydromass which is produced by a vortex-expeller-converter of my invention.

Since vortex-expeller walls 90, 92 are contoured in the form of an inclined circle, as shown in FIG. 4, the hydromasses pressing against these vortex-expeller walls (90, 92) cannot equilibrate (come to rest) at any one point of these passages because of the two principal features of my present invention, viz, (1) that the vortex-expeller walls do not lie perpendicular to the axis of rotation, and (2) by reason of the kinetic mass differential created in the manner indicated in FIG. 5.

Going to FIG. 5, and assuming that circle 130 represents a cylindrical vessel containing a working fluid and rotated about its vertical axis of symmetry 132, it will be understood that all centrifugal force vectors of all of the particles of the water in vessel 130 are directed outwardly, and that thus the radially directed forces at any point of the vessel wall, e.g., 130, are essentially balanced, in the sense that the immediately adjacent outwardly directed forces on either side thereof are equal, i.e., are in proportion to the 90° angles between the radius at point 134 and the tangent through point 134.

In the case of a containing wall contoured in accordance with the inclined circle principles of my invention, however, such as a containing wall or vessel wall represented by the curve 136 in FIG. 5, assuming that wall to be containing a body of water, and to be rotated about axis 132 in the same manner as vessel 130, the radially outwardly directed forces at any given point of the wall, e.g., point 138, will not be balanced from side to side of the radius through the point, but rather will be unbalanced in proportion to the magnitude of the angles included between the radius and the tangent at that point, i.e., in proportion to the 70° and 110° angles shown in FIG. 5.

Because of the fact that a mass of water cannot equilibrate or come to rest when thus rotated in a space bounded by such an inclined circle contoured wall, the water in vortex-expeller passages 120 and 122 must move outward, and acquire additional energy as it moves outward, until it reaches its highest value and passes through the expulsion ports 108, 110 at high pressure.

As will now be evident to those having ordinary skill in the art, informed by the present disclosure, the width of expulsion ports 108, 110 may be increased or decreased with respect to the widths indicated in FIG. 4 to produce higher or lower hydrodynamic pressures at expulsion ports 108, 110.

Upon exiting from expulsion ports 108, 110 the waters from vortex-expeller passages 120, 122 are forced by the increasing forces of centrifugation against the semi-elliptical hydraulic induction coil 124, wherein their pressure is increased by means of hydraulic induction, a principle of my invention which is analogous to electrical induction, as manifested for example in an electrical transformer.

It is to be understood that in accordance with the principles of my invention the resulting water pressure in coil 124 may also be increased or decreased by varying the number of turns of hydraulic induction coil 124, or by changing the angular velocity of the rotation of vortex-expeller rotor 20, or both.

I have discovered that the ultimate pressure in the hydraulic induction coil of a hydrocentrifugal machine of my present invention can be determined by multiplying the angular velocity of the vortex-expeller rotor by the number of turns of the associated hydraulic induction coil.

As will also now be evident to those having ordinary skill in the art, informed by the present disclosure, hydraulic induction coil 124 functions on what may be called a dynamic divide principal, whereby the mass of water in hydraulic induction coil 124 flows in either direction, i.e., the pressure in hydraulic induction coil 124 is transmitted in both directions along the continuous channel which makes up the coil, and thus cumulated pressure is experienced at both ends of hydraulic induction coil 124, i.e., at the lower end of penstock 30 and at the lower end of penstock 32.

These pressures in penstocks 30 and 32 will, of course, result in the forcing of more water into hydroturbine 12, bringing about the abovesaid output torque on output shaft 40, and also the efflux from hydroturbine 12 into inlet pipe 96 at the center of rotor 20.

It is to be noted, however, that when construcing alternative embodiments of my present invention the direction of advance or "handedness" of the hydraulic induction coil must be correctly related to the direction of expansion of the vortex-expeller walls, and the direction of rotation of the rotor.

Thus, in the preferred embodiment, when the rotor is rotated by electric motor 34 in the direction shown by the curved arrows in FIGS. 3 and 4, the configuration of the vortex-expeller walls 90 and 92, and the direction of advance of hydraulic induction coil 124 must be as shown in the present drawings.

That is, as shown in FIGS. 1 and 2, the turns of coil 124 must decline in a leftwardly direction, and induction coil 124 can be said to be a "left-hand" coil.

Also, it can be seen that rotor 20 is a "left-hand" rotor, because the non-radial components of the direction of the outer end of either vortex-expeller wall 90, 92 are directed counterclockwise, i.e., leftwardly.

Thus, it will be seen that in the preferred embodiment shown and described herein the hydraulic induction coil 124 is a left-hand coil, the rotor is left-handed, and the rotor is rotated by electric motor 34 in the lefthand, i.e., counterclockwise, direction.

Similarly, in an embodiment of my present invention in which the rotor is right-handed it would necessarily have to be rotated in a right-hand (clockwise) direction, and its associated hydraulic induction coil would have to be right-handed.

It is also to be noted, as particularly shown in FIG. 4, that the angular extent of each vortex-expeller wall is approximately 360°, about the axis of the vortex-expeller rotor.

It will thus be seen that the objects set forth above, among those made apparent from the preceding description, are efficiently attained, and since certain changes may be made in the above construction without departing from the scope of my present invention, it is intended that all matter contained in the above description or shown in the accompanying drawings shall be interpreted as illustrative only, and not in a limiting sense.

It is also to be understood that the following claim are intended to cover all of the generic and specific features of my present invention herein described, and all statements of the scope of my present invention which, as a matter of language, might be said to fall therebetween.

What I claim as new and desire to secure by Letters Patent is:

1. A hydrocentrifugal machine containing a body of working fluid, and comprising:

a stator chamber comprising a cylindrical wall and having first and second peripheral outlet ports, the principal part of the cylindrical walled stator chamber being divided into two parts by two generally spiral-shaped walls;

a hydroturbine mounted above said stator chamber, having two intake ports, and being adapted to emit its efflux into the central portion of a rotor chamber;

conduit means providing fluid passages from said outlet ports to corresponding ones of said hydroturbine intake ports; and rotor means rotatably mounted in said stator chamber and adapted to receive said efflux through its hollow shaft;

said hydroturbine comprising both impulse blade systems and reaction blade systems; and further including a helical channel member located in said stator chamber and affixed to the inner wall thereof, the lips of each turn of said helical channel being affixed to the lips of the adjacent turns thereof, and the open face of said helical channel facing the axis of said cylindrical chamber.

2. A hydrocentrifugal machine as claimed in claim 1 in which said rotor means comprises a cylindrical chamber having a tubular shaft located axially thereof and said tubular shaft is provided with two elongated ports for passing said efflux into the principal part of said cylindrical chamber.

3. A hydrocentrifugal machine as claimed in claim 1 in which each of said spiral-shaped walls of said cylindrical chamber extends from one of said elongated inlet ports to a corresponding outlet port in the outer wall of said cylindrical chamber.

4. A hydrocentrifugal machine as claimed in claim 1 in which said rotor means is mounted in said chamber by means of antifriction bearings.

* * * * *